US007183543B1

(12) United States Patent
Overney et al.

(10) Patent No.: US 7,183,543 B1
(45) Date of Patent: Feb. 27, 2007

(54) COMPENSATING FOR A MEASURED VARIATION IN LENGTH OF A FLIGHT TUBE OF A MASS SPECTROMETER

(75) Inventors: Gregor Overney, San Jose, CA (US); Jean-Luc Truche, Los Altos, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 0 days.

(21) Appl. No.: 11/333,744

(22) Filed: Jan. 17, 2006

(51) Int. Cl.
*H01J 49/00* (2006.01)

(52) U.S. Cl. ..... 250/287

(58) Field of Classification Search ..... 250/287, 250/281, 282
See application file for complete search history.

(56) References Cited

U.S. PATENT DOCUMENTS 6,013,913 A * 1/2000 Hanson ..... 250/287

* cited by examiner

*Primary Examiner*—Kiet T. Nguyen

(57) ABSTRACT

A mass spectrometer system comprises a flight tube having an operational length, a measurement device for measuring a variation in the longitudinal length of the flight tube, means for compensating for the measured variation in the longitudinal flight tube length, and a detector positioned near a downstream end of the flight tube. The measurement device comprises an optical interferometer, and may specifically comprise a Michelson interferometer. In a first embodiment, the mass spectrometer system includes an actuator coupled to the measurement device and the detector for moving the detector in a longitudinal direction to compensate for the measured variation in the operational flight tube length. In a second embodiment, the mass spectrometer system includes a processor coupled to the measurement device configured to calculate analyte ion mass to charge ratio. The processor is configured to modify a calculation of analyte ion mass to charge ratio using the measured variation in operational flight tube length.

17 Claims, 2 Drawing Sheets

1
22
29
27
26
25
30
20
50
Control Unit
(Processor)
28
35
12
15
18
4
Actuator
10

COMPENSATING FOR A MEASURED VARIATION IN LENGTH OF A FLIGHT TUBE OF A MASS SPECTROMETER

FIELD OF THE INVENTION

The present invention relates to mass spectrometry, and more particularly, but without limitation, relates to a method and apparatus for measuring variation in the length of a mass spectrometer flight tube using optical interferometry, and compensating for the measured variation in length.

BACKGROUND INFORMATION

Time-of-flight (TOF) mass spectrometers derive calculations of ion masses from direct measurements of ion flight time within a flight tube, where the mass is proportional to the square of the flight time. The flight time is directly proportional to the length of the flight tube, and any minute change in the length of the flight tube due to temperature fluctuations correspondingly changes the measured ion flight time and results in inaccuracies in the calculation of ion mass. For example, a 1 μm change in a one-meter-long flight tube translates into a 2 ppm (parts per million) change in calculated mass.

There are two conventional techniques for dealing with this problem. The first is to attempt to stabilize the temperature of the flight tube by isolating it and insulating it from ambient temperature fluctuations. One significant problem with this method, apart from the inconvenience of physically isolating and insulating the flight tube, is that the ion beam traveling within the flight tube can itself cause increase in the temperature of the walls (usually composed of stainless steel) of the flight tube, so that no amount of structural isolation and insulation can completely eliminate temperature fluctuations. The second conventional technique is to compensate for any variation in the length of the flight tube by using a reference mass to calibrate analyte ion mass calculations. A shift in the calculated mass of the reference compound can be identified and this shift can be accounted for in the calculations of the analyte ion masses. However, with this technique, the inclusion of the reference mass can interfere with the detection and analysis of analyte ions because the mass of the reference compound may overlap closely with the mass of a detected analyte ion or one of its isotopes. This may result in an erroneous analysis of the composition of analyte compounds.

SUMMARY OF THE INVENTION

The present invention enables the changes in the length of the flight tube caused by temperature fluctuations to be compensated for without the need to employ reference masses.

In a first aspect, the present invention provides a mass spectrometer system that comprises a flight tube having an operational length, a measurement device for measuring a variation in the operational length of the flight tube, means for compensating for the measured variation in the operational flight tube length, and a detector positioned near a downstream end of the flight tube. The measurement device comprises an optical interferometer, and may specifically comprise a Michelson interferometer.

According to a first embodiment, the mass spectrometer system includes an actuator coupled to the measurement device and the detector for moving the detector in a longitudinal direction to compensate for the measured variation in the operational flight tube length.

According to a second embodiment, the mass spectrometer system includes a processor coupled to the measurement device configured to calculate the analyte ion mass to charge ratio.

In another aspect, the present invention provides a method of compensating for variation in an operational flight tube length in a mass spectrometer having a detector situated within a flight tube. The method comprises measuring a change in the operational flight tube length from an operational reference length and changing a longitudinal position of the detector within the flight tube corresponding to the measured change to reestablish the operational reference length.

In a further aspect, the present invention provides a method of compensating a determination of analyte ion mass to charge ratio for variation in an operational length of a flight tube in a mass spectrometer. The method comprises measuring a change in the operational flight tube length, determining a correction to a coefficient used in a calculation of the analyte ion mass to charge ratio based on the change in the operational flight tube length, and calculating a compensated analyte ion mass to charge ratio using the correction to the coefficient.

DETAILED DESCRIPTION

It is initially noted that reference to a singular item herein includes the possibility that there are plural of the same items present. More specifically, as used herein and in the appended claims, the singular forms "a", "an", "said" and "the" include plural referents unless the context clearly dictates otherwise.

The term "adjacent" as used herein means near, next to or adjoining. Something adjacent may also be in contact with another component, surround (i.e. be concentric with) the other component, be spaced from the other component or contain a portion of the other component.

According to the present invention, changes in the operational length of a mass spectrometer flight tube due to temperature fluctuations are precisely measured using an optical interferometer. According to one embodiment, an optical interferometer is coupled to the detector of the mass spectrometer such that changes in the flight tube length are directly translated into a movement of a mirror of the optical interferometer, resulting in a shift in the interference pattern generated by the interferometer. This shift in the interference pattern yields a very accurate measurement of the change in the operational flight tube length.

The present invention provides two distinct techniques for compensating for changes in flight tube length. According to a first technique, a control unit operates an electrically-driven actuator coupled to the detector and directs the actuator to move the detector to precisely counteract the measured change in operational flight tube length. This technique enables the ion flight path length to remain constant despite any changes in overall flight tube length due to temperature fluctuations.

In a second technique, the measured change in flight length is taken into account in the computations of ion mass to charge ratio at the data analysis stage.

Figure 1:
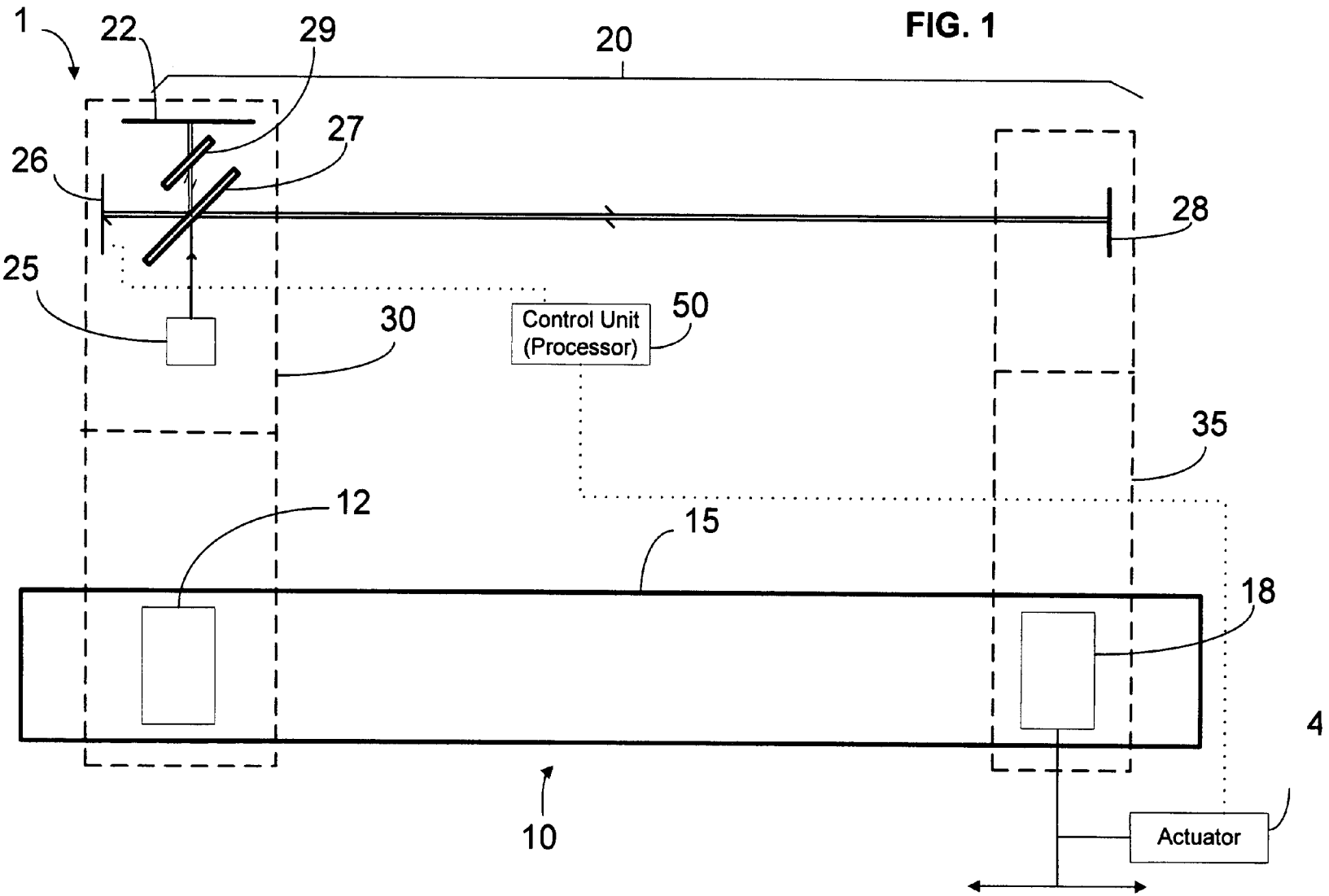
FIG. 1 shows an embodiment of a mass spectrometer system in which an optical interferometer is coupled to a flight tube according to the present invention.

FIG. 1 shows a mass spectrometer system 1 including a mass spectrometer 10 and an optical interferometer 20 which is coupled to the mass spectrometer. The mass spectrometer 10 comprises a source of ions 12, a flight tube 15 and a detector 18, among other components not shown but readily known to those of skill in the art. Ions output from the source 12 are pulsed by electrostatic forces into the flight tube 15 and thereafter traverse the length of the flight tube toward the detector 18. This main length of the flight along which ions travel is termed herein the 'longitudinal length' of the flight tube 15, and the length of the path between the ion source and the detector is termed the 'operational flight tube length'. Some time-of-flight mass spectrometers also include a reflectron to minimize dispersion of the displacement of ions with equal mass to charge ratio. For the purpose of simplifying the description, such a reflectron is not included in the text or figures, but the teachings herein apply equally to embodiments in which a reflectron is employed. Through use of a reflectron or otherwise, the measured flight times of ions of equal mass to charge ratio are made to coincide, so that there is a precise correspondence between mass to charge ratio and measured flight time. However, to calculate an ion mass to charge ratio directly from measured flight time requires an accurate measurement of the operational flight tube length.

An optical interferometer 20 is used in this context to determine any changes in the operational flight tube length from a base measurement, which may be a measurement taken before a set of experiments and entered into an analysis system, for example. In the embodiment depicted in FIG. 1, the optical interferometer comprises a Michelson interferometer configuration, although this is only one possible implementation. The components and operation of the Michelson interferometer are well known in the optical arts and only a brief description is provided herein.

A Michelson interferometer breaks a beam of light into two paths and then recombines them to create an interference pattern. The interferometer 20 includes a fixed mirror 22 fixed in position with respect to the proximate end of the flight tube 15 adjacent to the ion source 12 via a physical coupling arrangement 30, and a movable mirror 28 fixed in position with to the distal end of the flight tube 15 (and the detector 18) via another physical coupling arrangement 35. As shown, the fixed mirror 22 is aligned so that it reflects light in a direction perpendicular to the longitudinal direction, while the movable mirror is aligned so that it reflects light longitudinally.

A coherent light source 25, which may comprise a laser diode, for example, is positioned near the proximate end of the interferometer 20 and directs light directly toward the fixed mirror 22. A beam splitter 27, which is half-silvered on one surface and oriented at a 45 degree angle with respect to the direction of the light emitted from the source 25, is positioned between the light source 25 and the fixed mirror 22 to reflect a portion of the light from the source 25 toward the movable mirror 28 in a 'forward' direction. The light that impacts the movable mirror 28 is reflected back in the reverse direction toward the beam splitter 27. A portion of this light is transmitted through the beam splitter to a detector 26, which may constitute a two-dimensional optical detector, such as an optical mouse sensor as described in U.S. Pat. No. 5,686,720 to Gordon et al. The path from the light source 25 to the beam splitter 27 to the movable mirror 28 and back to the detector 26 constitutes the first of the two interfering light paths.

The beam splitter 27 also transmits the remaining portion of the light from the source 25 to the fixed mirror 22. The light incident to the fixed mirror 22 is reflected back toward the beam splitter 27 which reflects a portion of this reflected light in a 'reverse' direction toward a detector 26. The path light traverses from the light source 25 through the beam splitter 27 to the fixed mirror 22, back to the beam splitter and then to the detector 26 constitutes the second of the two interfering light paths. Between the beam splitter 27 and the fixed mirror 22, a compensator 29 is included having the same thickness and material as the beam splitter so that both the first and second light paths traverse the same thickness of glass. This removes any possible differential refractive effects.

At the detector 26, the two paths combine to create an interference pattern which typically includes a series of concentric light and dark fringes. Before the movable mirror has moved, the detector 26 detects a reference pattern. When subsequent patterns are obtained after any movement of movable mirror 28, a precise measurement of the distance of this movement can be made by counting the number of interference fringes which have moved past a point in the reference pattern. To ensure accuracy, care is taken that the coherence length of the light source is of a magnitude that the unequal lengths of the first and second interfering light paths does not affect fringe visibility. A laser diode source generally suffices for this purpose. This measurement may be made automatically using a pattern recognition algorithm.

As noted previously, the fixed mirror 22 is physically coupled to the proximate end of the mass spectrometer 10 through coupling arrangement 30, and the movable mirror 28 is physically coupled to the distal end via coupling arrangement 35. If the flight tube 15 expands or contracts due to temperature fluctuations, this movement is translated to the movable mirror 28 through the coupling arrangement 35 which then moves in accordance with the expansion or contraction of the flight tube 15. This movement will change the length of the first light path, which is reflected in a shift in the interference pattern at the detector 26.

A control unit or processor 50 having image processing and pattern recognition function may be electrically connected to the deter 26 (the connection being shown as a dotted line) for determining the change in the operational length of the flight tube 15 from the shift in the interference pattern.

Once a length change has been determined, various compensation methods may be employed to compensate for this shift. In a first embodiment, the control unit controls 50 an electrically-driven actuator 40, such as a micromotor or piezoelectric device, which move the detector 18 of the mass spectrometer 18 for the same distance but in an opposite direction from the movement that has occurred due to expansion or contraction of the flight tube 15. In this manner, the operational length of the flight tube, i.e., the distance that ions actually travel in the flight tube 15 from the ion source 12 to the detector 18, is maintained as a constant distance even as the length of actual housing of the flight tube changes.

Another embodiment of a compensation method according to the present invention involves making a correction to a coefficient used to calculate ion mass based on the change in the operational length of the flight tube. Since the kinetic energy, $mv^2/2$, is equal to Uz, where U is the electric potential drop across the acceleration region of the flight tube and z is the charge of the ion, ion mass to charge ratio (m/z) can be expressed as a function of ion velocity as follows:

$$m/z=2U/v^2 \quad (1).$$

As ion velocity (v) is simply the operational length of the flight tube (d) divided by the measured flight time (t) of the ion (v=d/t), equation (1) can be expressed as:

$$m/z=(2U/d^2)t^2 \quad (2).$$

The $2U/d^2$ term in equation (2) can be expressed as a coefficient (A) that will change through the $d^2$ term due to temperature fluctuations. In other words, equation (2) can be rewritten as:

$$m/z=At^2 \quad (3)$$

Thus, when a change in the distance (d) has been detected, a correction to the coefficient (A) is calculated in order to obtain an accurate value for the ion mass to charge ratio (m/z).

Figure 2:
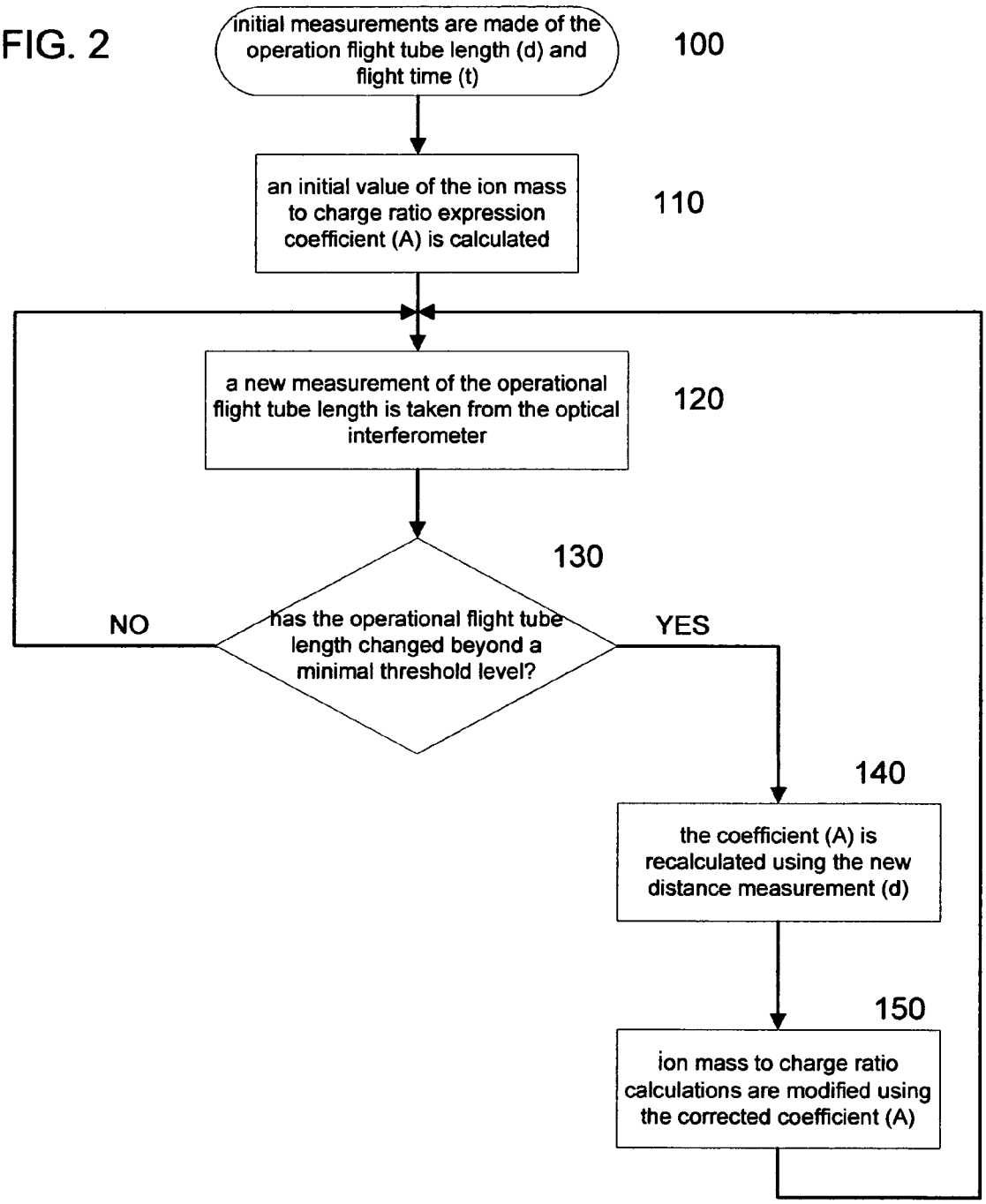
FIG. 2 is a flow chart of an embodiment of a method for compensating for changes in the flight length of a mass spectrometer according to the present invention.

FIG. 2 is a flow chart of an exemplary process flow for determining an accurate value of ion mass to charge ratio (m/z) using the set of equations above. At the commencement, initial measurements are made of the operation flight tube length (d) and flight time (t) (step 100). From these measurements and knowledge of the energy imparted to the ions as are accelerated into the field-free region of the flight tube, an initial value of the mass to charge ratio coefficient (A) is calculated (step 110). In step (120), a new measurement of the operational flight tube length is taken from the optical interferometer. In step (130), it is determined whether the operational flight tube length has changed beyond a minimal threshold level (ξ). If it has (step 140), the coefficient (A) is recalculated using the new distance measurement (d), and mass to charge ratio calculations are modified using the corrected coefficient (A) (step 150). Afterwards the process cycles back to step (120). If in step (130), it is determined that the operational flight tube length has not changed beyond the minimal threshold level (ξ), the process cycles back to step (120) and new measurements are taken. This process is continual, with the monitoring of the operational length ongoing as long as the mass spectrometer system is in use.

Having described the present invention with regard to specific embodiments, it is to be understood that the description is not meant to be limiting since further modifications and variations may be apparent or may suggest themselves to those skilled in the art. It is intended that the present invention cover all such modifications and variations as fall within the scope of the appended claims.

What is claimed is:

1. A mass spectrometer system comprising:

a flight tube having an operational length;

a measurement device for measuring a variation in the operational length of the flight tube;

means for compensating for the measured variation in the operational length; and a detector positioned near a downstream end of the flight tube.

2. The mass spectrometer system of claim 1, wherein the compensation means includes an actuator coupled to the measurement device and the detector, for moving the detector in a longitudinal direction to compensate for the measured variation in the operational flight tube length.

3. The mass spectrometer system of claim 2, wherein the measurement device comprises an optical interferometer coupled to the actuator that includes a detector that detects a magnitude and direction of a change from a reference interference pattern in response to a variation in operational flight tube length and outputs a signal to the actuator indicative of the magnitude and direction, the actuator moving the detector based oh the received signal.

4. The mass spectrometer system of claim 3, wherein the interferometer and actuator operate using closed loop feedback to reestablish the reference interference pattern.

5. The mass spectrometer system of claim 4, wherein the actuator comprises a micromotor.

6. The mass spectrometer system of claim 1, further comprising:

a processor coupled to the measurement device configured to calculate analyte ion mass to charge ratio from measured flight time;

wherein the processor modifies a calculation of analyte ion mass to charge ratio based on the measured ion flight time of the ion and a measured variation in operational flight tube length.

7. The mass spectrometer system of claim 1, wherein the measurement device comprises an optical interferometer.

8. The mass spectrometer system of claim 7, wherein the optical interferometer comprises a Michelson interferometer.

9. The mass spectrometer system of claim 8, wherein the Michelson interferometer includes a movable optical element that is physically coupled to the detector such that the movable optical element and the detector move equivalently in a longitudinal direction.

10. The mass spectrometer system of claim 9, wherein the movable optical element comprises a mirror.

11. The mass spectrometer system of claim 10, further comprising:

an ion source physically coupled to the Michelson interferometer.

12. A method of compensating for variation in an operational flight tube length in a mass spectrometer having a flight tube and a detector, the method comprising:

measuring a change in the operational flight tube length from an operational reference length; and changing a longitudinal position of the detector corresponding to the measured change to reestablish the operational reference length.

13. The method of claim 12, wherein the measuring of the change in the operational flight tube length comprises using an optical interferometer.

14. The method of claim 13, wherein the optical interferometer comprises a Michelson interferometer.

15. A method of compensating a determination of analyte ion mass to charge ratio for variation in an operational length of a flight tube in a mass spectrometer, the method comprising:

measuring a change in the operational flight tube length;

determining a correction to a coefficient used in a calculation of the analyte ion mass to charge ratio based on the change in the operational flight tube length; and calculating a compensated analyte ion mass to charge ratio using the correction to the coefficient.

16. The method of claim 15, wherein the measuring of the change in the operation flight tube length is performed by optical interferometry.

17. The method of claim 16, wherein the optical interferometer comprises a Michelson interferometer.

* * * * *